United States Patent [19]

Maroski, Jr.

[11] 3,991,780

[45] Nov. 16, 1976

[54] COMBINATION ARCHERY BOW STAND, WALKING CANE AND ANIMAL DRAGGING DEVICE

[76] Inventor: Frank M. Maroski, Jr., R.D. 2 Box 381, Bath, Pa. 18014

[22] Filed: Feb. 10, 1976

[21] Appl. No.: 656,830

[52] U.S. Cl. ..... 135/66; 248/122; 248/156

[51] Int. Cl.[2] ..... A45F 3/44; A45B 1/00; A45B 5/00

[58] Field of Search..... 248/122, 156; 124/23 R; 135/47

[56] References Cited

UNITED STATES PATENTS

| | | | |
|---|---|---|---|
| 879,052 | 2/1908 | Jeranek | 248/156 X |
| 1,851,779 | 3/1932 | Slater | 124/23 R X |
| 2,275,870 | 3/1942 | Sheldon | 248/156 |
| 2,593,789 | 4/1952 | Pearson | 248/156 X |
| 3,007,581 | 11/1961 | Moore | 248/156 |
| 3,219,299 | 11/1965 | Snider et al. | 248/156 |
| 3,256,872 | 6/1966 | Koser | 211/60 R X |
| 3,286,961 | 11/1966 | Mandolare | 248/122 X |
| 3,441,241 | 4/1969 | Brooks | 248/156 |
| 3,584,820 | 6/1971 | Butcher, Sr. | 248/122 |

*Primary Examiner*—Werner H. Schroeder
*Assistant Examiner*—Conrad L. Berman
*Attorney, Agent, or Firm*—Fred Fisher

[57] ABSTRACT

A combination archery bow stand, walking cane, and animal dragging device includes a pair of elongated members wherein one of the members has an end thereof engaged and adapted to reciprocate axially with respect to the other member. A bolt and wing nut combination is coupled to one of the members for axially affixing the members together in fixed relationship. An L-shaped bracket has one portion thereof affixed axially to a point intermediate the ends of one of the members and has a second portion extending perpendicularly to the principal axis of that member for providing support to an archer bow. Additional support is provided by a support means which is affixed to the non-engaged end of the other member and extends outwardly parallel to the second portion of the first support means, and is bend inwardly towards said other portion. The second support means provides the various functions of a handle for a walking cane, and a hook for hanging the combination on a protuberance, such as a limb of a tree. The second support means, in addition to the L-shaped bracket, provides the functions of providing engagements for supporting an archery bow. A ring is affixed to the second member and to the second support means, the ring being adapted to hold an end of a rope wherein the opposite end of the rope has a loop formed therein. The other end of the combination can have its member formed with a pointed tip. The rope can be formed of nylon, and the members can be formed of aluminum.

10 Claims, 7 Drawing Figures

COMBINATION ARCHERY BOW STAND, WALKING CANE AND ANIMAL DRAGGING DEVICE

BACKGROUND OF THE INVENTION

1. Field of the Invention

This invention relates to a combination archery bow stand, walking cane, and animal dragging device. Accordingly, it is a general object of this invention to provide new and improved combinations of such character.

2. Description of the Prior Art

In accordance with a preliminary novelty search performed on behalf of the inventor, the following United States patents of interest were found:

| Pat. No. | Patentee |
|---|---|
| 879,052 | Jeranek |
| 2,275,870 | Sheldon |
| 2,593,789 | Pearson |
| 3,179,102 | Peckham |
| 3,219,299 | Snider, et al |
| 3,256,872 | Koser |
| 3,344,551 | Chestnut |
| 3,441,241 | Brooks |
| 3,584,820 | Butcher, Sr. |
| 3,623,685 | Thomson |

The field of search included the following subclasses:

| |
|---|
| 124-23, 25 |
| 211-13 |
| 224-7R, 46R, 49, 58 |
| 248-122, 156 |

Jeranek, U.S. Pat. No. 879,052 discloses a stick in the ground and a telescoping gun rest.

Sheldon, U.S. Pat. No. 2,275,870 discloses a support for an archer's bow.

Pearson, U.S. Pat. No. 2,593,789 discloses a bow support with a pointed tip.

Peckham, U.S. Pat. No. 3,179,102 relates to an attachment blind for archers.

Snider, et al, U.S. Pat. No. 3,219,299 relates to a bow stand.

Koser, U.S. Pat. No. 3,256,872 discloses a stand for archery bows.

Chestnut, U.S. Pat. No. 3,344,551 discloses a stick in the ground; a fishing pole holder which can also be used as a walking cane.

Brooks, U.S. Pat. No. 3,441,241 discloses an adjustable folding or collapsible bow holder.

Butcher, Sr. U.S. Pat. No. 3,584,820 discloses a support or rest for an archery bow.

Thomson, U.S. Pat. No. 3,623,685 relates to a device for supporting a fishing pole or hand line in an elevated position including a tubular stake.

SUMMARY OF THE INVENTION

This invention is directed primarily to the archery hunter who desires an implement which has many uses and is relatively inexpensive. The combination described herein can be used as a walking cane so that the hunter can utilize the combination while going through the forest as a walk-cane to assist him in traversing the ground which may be level, hilly, unlevel, etc. The combination can also be used as a support for an archery bow, e.g., when an animal, such as a deer, is not in sight, the hunter can place his archer's bow onto the support provided by the novel combination and await the appearance of an animal. When the animal appears, the hunter can quickly remove the bow from the support and utilize the bow in normal fashion.

When occasion, it is desirable to climb a tree in order to observe the presence of deer which may be nearby. With the novel combination described herein, the hunter can lift the combination over his head and hook same onto a branch of a tree, and place the bow onto the supports of the combination. The hunter then climbs the tree and, when he gets to a suitable height, can lift the combination and bow onto a higher branch, enabling the hunter to continue to climb the tree.

The combination has a rope attached thereto to aid in dragging the deer and to otherwise aid in gutting a deer, and, thus, the combination serves for a multitude of purposes.

Thus, it is an object of this invention to provide a novel support for an archer's bow.

It is another object of this invention to provide a novel bow holder for aiding in lifting a bow at higher altitudes, such as by climbing a tree.

Still another object of this invention is to provide a novel device for aiding in gutting and dragging animals, such as deer.

Still another object of this invention is to provide a novel walking cane.

Yet another object of this invention is to provide a novel combination which can satisfy foregoing objects.

In accordance with a preferred embodiment of this invention, a combination archery bow stand, walking cane, and animal dragging device includes a variety of elements, such as a first elongated member having a second elongated member with an end thereof engaged and adapted to reciprocate axially with respect to the first member. Suitable means are coupled to one of the members for axially affixing the members together in fixed relationship. A first support means is affixed intermediate the ends of the first member and extends perpendicular to the principal axis of the first member. Second support means are affixed to the non-engaged end of the second member and extends outwardly parallel to the first support means, and bent inwardly to said first support means. The second support means provides the various functions of a handle for a walking cane and a hook for hanging the combination on a protuberance. Both of the support means provide the function of providing engagements for supporting an archer's bow. A ring is affixed to the second support means and to the second member, and a rope has one end affixed to the ring.

In accordance with other features of the invention, the first elongated member can have a pointed tip at one end and a tubular portion at the other end. The second member can have one end thereof engaged and adapted to reciprocate axially with respect to the first member, and have another end thereof with a female thread. The coupling means can include a bolt and wing combination coupled to the first member for axially affixing the members together in a fixed relationship. The first support means can include an L-shaped bracket having one portion thereof affixed axially to a point intermediate the end of the first member and having a second portion extending perpendicularly to the principal axis of the first member. The second support means and the ring can be joined together with a male thread extending therefrom for engagement with the female thread. The rope has the other end thereof formed in a loop. The rope can be formed of nylon, and the members can be formed of aluminum.

BRIEF DESCRIPTION OF THE DRAWINGS

Other objects, advantages, and features of this invention will become more apparent from a reading of the following specification, when read in conjunction with the accompanying drawings, in which.

DESCRIPTION OF A PREFERRED EMBODIMENT

Figures 1, 2, 3, 4, 5, 6, 7:
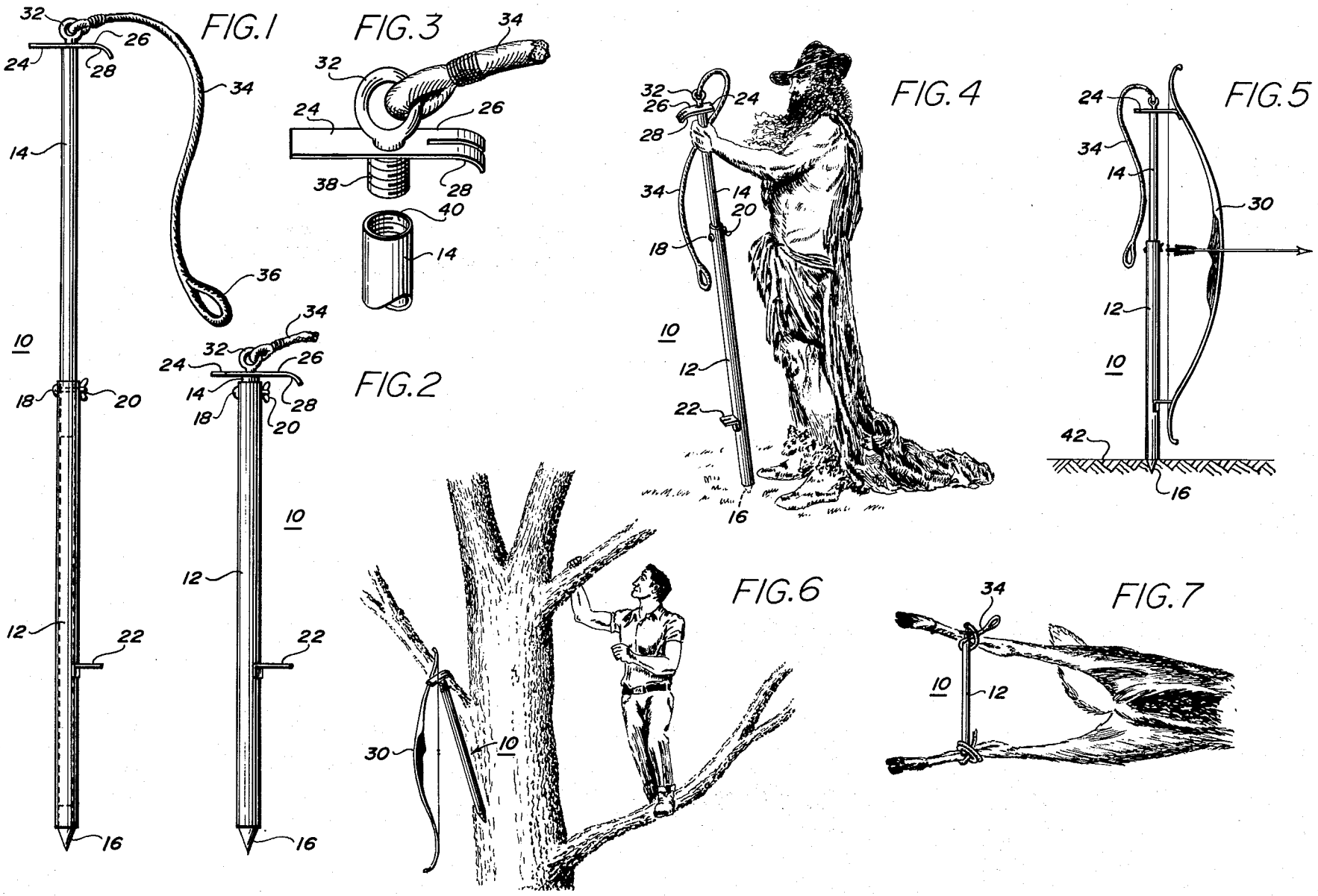
FIG. 1 is an elevational of one embodiment of this invention with the elongated member shown in an extended form.
FIG. 2 is an elevational view of the device shown in FIG. 1 with its members shown in its contracted form.
FIG. 3 is an exploded view, partially in section, illustrating, in perspective, portions of the embodiment shown in FIGS. 1 and 2.
FIG. 4 is a diagrammatic representation of the novel combination used as a walking cane.
FIG. 5 is a diagrammatic representation of the invention used as a support for an archer's bow when the bow is not in use.
FIG. 6 is a diagrammatic representation of the device shown in FIGS. 1 and 2, illustrating its use in lifting an archer's bow up a tree.
FIG. 7 is an illustration depicting an embodiment of this invention in use for gutting deer.

Referring to the drawings, there is shown, especially at FIGS. 1 and 2, a preferred embodiment of the invention. A combination archery bow stand, walking cane, and animal dragging device 10 includes a first elongated member 12. The member 12, preferably, is cylindrical and may be tubular so as to receive a second elongated member 14 therewithin, so that the second elongated member 14 has an end thereof adapted to reciprocate axially and engage with the first member 12. At the bottom of the first member 12 is a pointed tip 16.

To properly couple the two members 12, 14 together so as to axially affix them in a fixed relationship, it is a preferred mode to utilize a bolt 18 and wing nut 20 combination.

The bolt 18 fits within a hole which is located on each side of the member 12 and can engage within a series of suitable holes (not shown) that are axially aligned along the member 14. Thus, the novel combination can be varied from a retracted position of 3 feet, 4 inches to 5 feet (for use with a magnum bow) and to 6 feet (for use with a regular recurve bow), in accordance with a preferred mode contemplated by the inventor.

At a point intermediate the ends of the first member 12 is a support formed by an L-shaped bracket 22 having one portion thereof affixed axially to the member 12 so that the other portion of the L-shaped bracket extends outwardly away from the member 12 in a direction perpendicular to the axis of the elongated member 12.

As shown in FIGS. 1, 2, and 3, a support means 24 is affixed to the non-engaged end of the second member 14. The support means 24 extends outwardly, as at 26, in a direction parallel to the second portion of the L-shaped bracket 22, and, continuing, the support means 24 is bend inwardly, as at 28, toward the first support means 22.

The support means 24 provides various functions of a handle for a walking cane and hook for hanging the combination on a protuberance such as a tree limb.

Both the support means 22 and 24 provide the function of providing engagements for supporting an archery bow 30.

A ring 32 is affixed to the support 24 and to the second member 14.

A nylon rope 34 has one end thereof affixed to the ring 32 while the other end is formed with a loop 36.

Referring to FIG. 3 a preferred form of the invention is to have the ring 32 and support means 24 formed together in an integral relationship together with a threaded male member 38. The free end of the member 14 has an internal thread 40 which is adapted to engage with the male thread 38 so that the ring 32, support means 24, and the rope 34 are formed together as one unit and can be removable or engagable at will with the second support member 14 and the rest of the overall combination.

In a preferred embodiment, the members 12, 14 are formed of aluminum and the overall length in its extended position is 6 feet, while in a retracted position is 3 feet and 4 inches, as stated above. The length of the nylon rope is, preferably, 3 feet.

The combination 10 can be used in either an extended position as depicted in FIG. 1 or in a retracted position, as depicted in FIG. 2. The upper handle, including the support 24 and the ring 32 can be removed, as depicted in FIG. 3.

The overall combination 10, preferably in the retractable form depicted in FIG. 2, can be used as a walking cane, as depicted generally at FIG. 4.

The overall combination 10, in an extended position, can be used as a support for an archery bow 30 as depicted in FIG. 5. The top of the bow 30 is engaged about the top at the support 24, and the bow engages the L-shaped bracket 22 at the bottom thereof.

In use, a hunter inserts the pointed tip 16 of the combination 10 into the ground 42. Then, he hangs the bow 30 about the support 24 and engages the bottom of the bow 30 with the L-shaped bracket 22. The hunter can then rest and await the presence of game, such as a deer. Upon viewing his prey, the hunter simply and easily removes the bow 30 from the bow support 10, and can use the bow 30 in normal manner without the bow 30 being encumbered by the combination 10.

On occasion, it is desired that a hunter climb a tree in order to obtain a better view of the game situation. In so doing, the hunter extends the combination 10 and hooks the upper support 24 about a limb of a tree, as depicted in FIG. 6. He then raises his bow on top of the support 24 and proceeds to climb the tree. Upon getting part way up the tree, the hunter can reach out, grab ahold of the combination 10 with the bow, and lift the device 10 together with the bow 30 to a higher branch, whereupon the hunter can then proceed to climb further up the tree until he reaches a desired level. Thereupon, he can simply remove the bow 30 from engagement with the device 10 and use the bow 30 in normal manner.

The device 10 can be used for various purposes, such as to spread apart the legs of a deer so that the deer can be gutted. The rope can be removed, as by unscrewing the male thread 38 from the internal thread 40 so as to loop the rope in a fashion so as to engage the animal and drag the animal a desired distance.

In summary, the overall combination, as taught herein, provides a variety of features;

1. It provides an adjustable archery bow support which can extend a distance of 6 feet in accordance with the preferred embodiment of the invention, with a dragging rope having a length of 3 feet. It is to be understood, however, that in accordance with the invention it may be desired to have different dimensions, either longer or shorter, depending upon individual preferences.

2. A walking cane or walking stick having a height of 3 feet, 4 inches. Again, sizes may vary according upon whether or not a hunter may prefer a taller or shorter walking cane. Obviously, tall people prefer tall canes, and short people prefer short canes.

3. One or two men can utilize the device by extending same a distance of about four feet to aid in dragging a deer or other animal. In such usage, the rope and support combination can be looped about the neck and feet of a deer and, utilizing the loop 34, can be inserted into the tubular members 12, 14 to add support thereto. The loop 36 can be placed midway between the two ends of the device 10, and, at each end, a man could grab ahold of the device to help in dragging or carrying the deer.

4. The device 10 can be used as a pole to prop the legs of the deer apart so as to simplify gutting.

5. The device can be used as a pole to lift a bow, either tied thereto or supported thereby, to raise same onto a tree.

6. The device can be used as a pole to hang a deer in a tree in such manner so that the limbs and neck of a deer can be attached to the extremities of the device 10 and a rope used midway between the ends of the device to raise same onto a tree limb.

7. The invention can be used in outdoor tournament shooting and in boat club courses.

As a safety element, for backyard target practice, the bow could be supported off the ground with the novel combination, thus preventing any damage to the bow itself, its sights, or arrows. Thus, injury to persons can be prevented.

Though dimensions can vary, as stated earlier, it is preferred that the tubular member 12 be formed of ¾ inch aluminum tubing.

Other modifications may be performed without departing from the spirit and scope of this invention. For example, materials other than aluminum or nylon can be used. Fasteners other than bolt and wing nut combinations can be used.

It will be recognized that this invention satisfies a variety of needs of a hunter, while at the same time can be economically constructed. It is light in weight and is easily adaptable.

What is claimed is:

1. A combination archery bow stand, walking cane, and animal dragging device comprising a first elongated member;

a second elongated member having an end thereof engaged and adapted to reciprocate axially with respect to said first member;

means coupled to one of said members for axially affixing said member together in fixed relationship;

first support means affixed intermediate the ends of said first member and extending perpendicular to the principal axis of said first member;

second support means affixed to the non-engaged end of said second member and extending outwardly parallel to said first support means and bent inwardly toward said first support means, said second support means providing the various functions of a handle for a walking cane and a hook for hanging said combination on a protuberance, both said support means providing the function of providing engagements for supporting an archery bow;

a ring affixed to said second support means and said second member; and a rope having one end affixed to said ring.

2. The combination as recited in claim 1 wherein the other end of said rope is formed in a loop.

3. The combination as recited in claim 1 wherein said first member has a pointed tip.

4. The combination as recited in claim 1 wherein said first member is tubular, and said second member is reciprocable therewith.

5. The combination as recited in claim 1 wherein said coupling means includes a bolt and wing nut combination.

6. The combination as recited in claim 1 wherein said second support means and said ring are joined together with a first connecting means, and wherein said non-engaged end of said second member has a second connecting means adapted to engage with said first connecting means.

7. The combination as recited in claim 6 wherein said first connecting means includes a male thread and wherein said second connecting means includes a female thread.

8. The combination as recited in claim 1 wherein said first elongated member has a pointed tip at one end and a tubular portion at the other end thereof;

said second member has an end thereof engaged and adapted to reciprocate axially with respect to said first member, and has another end thereof with a female thread;

said coupling means includes bolt and wing nut means coupled to said first member for axially affixing said members together in fixed relationship; said first support means includes an L-shaped bracket having one portion thereof affixed axially to a point intermediate the ends of said first member and having a second portion extending perpendicularly to the principal axis of said first member;

said second support means and said ring are joined together with a male thread extending therefrom for engagement with said female thread; and said rope has the other end thereof formed in a loop.

9. The combination as claimed in claim 8 wherein the rope is nylon.

10. The combination as claimed in claim 9 wherein said members are formed of aluminum.

* * * * *